United States Patent [19]

Sawazaki

[11] 4,385,507

[45] May 31, 1983

[54] YARN FEEDING AND CHANGING APPARATUS FOR CIRCULAR KNITTING MACHINES

[75] Inventor: Masatoshi Sawazaki, Kobe, Japan

[73] Assignee: Precision Fukuhara Works, Ltd., Kobe, Japan

[21] Appl. No.: 232,511

[22] Filed: Feb. 9, 1981

[30] Foreign Application Priority Data

Sep. 4, 1980 [JP] Japan ..... 55-122570

[51] Int. Cl.[3] ..... D04B 15/61

[52] U.S. Cl. ..... 66/140 R; 66/219; 66/225

[58] Field of Search ..... 66/131, 134, 138, 139, 66/140 R, 140 S, 145 R, 219, 225

[56] References Cited

U.S. PATENT DOCUMENTS

| | | | |
|---|---|---|---|
| 1,115,128 | 10/1914 | Swinglehurst | 66/140 R X |
| 3,625,027 | 12/1971 | Piana et al. | 66/139 X |
| 3,975,926 | 8/1976 | Tenconi | 66/131 X |

FOREIGN PATENT DOCUMENTS

| | | | |
|---|---|---|---|
| 1065126 | 9/1959 | Fed. Rep. of Germany | 66/225 |
| 2710044 | 9/1977 | Fed. Rep. of Germany | 66/139 |
| 2805779 | 8/1978 | Fed. Rep. of Germany | 66/140 R |
| 1340280 | 9/1963 | France | 66/131 |
| 367084 | 2/1932 | United Kingdom | 66/140 R |
| 1164451 | 9/1969 | United Kingdom | 66/138 |

*Primary Examiner*—Wm. Carter Reynolds
*Attorney, Agent, or Firm*—Nathan Levin

[57] ABSTRACT

Yarn feeding and changing apparatus for multi-feed sinker top circular knitting machines having a single circle of needles, wherein a yarn striper box is placed within the needle circle at each feed of the machine to provide a circle of boxes, and wherein a remotely programmed yarn selector is provided within the circle of boxes, the yarn selector and the circle of needles rotating in unison relative to the circle of yarn boxes. Each striper box is provided with a plurality of yarn feeding fingers and with a rocker, a control jack, and a clamp and cutter individual to each finger, the jacks controlling the rockers to move the fingers between feeding and idle positions. The yarn selector acts on the jacks to provide a yarn selection individual to each of the boxes. Each clamp and cutter is partially opened by its related rocker when its related yarn finger is moved to idle position and is thereafter fully opened and closed by the yarn selector. The clamp and cutter of a related yarn being moved to feeding position is retained in closed position by its related rocker during the yarn change. A yarn guide member causes each incoming one of the plurality of yarns to be fed to the needles at the same place in the needle circle.

10 Claims, 11 Drawing Figures

Figure 1:
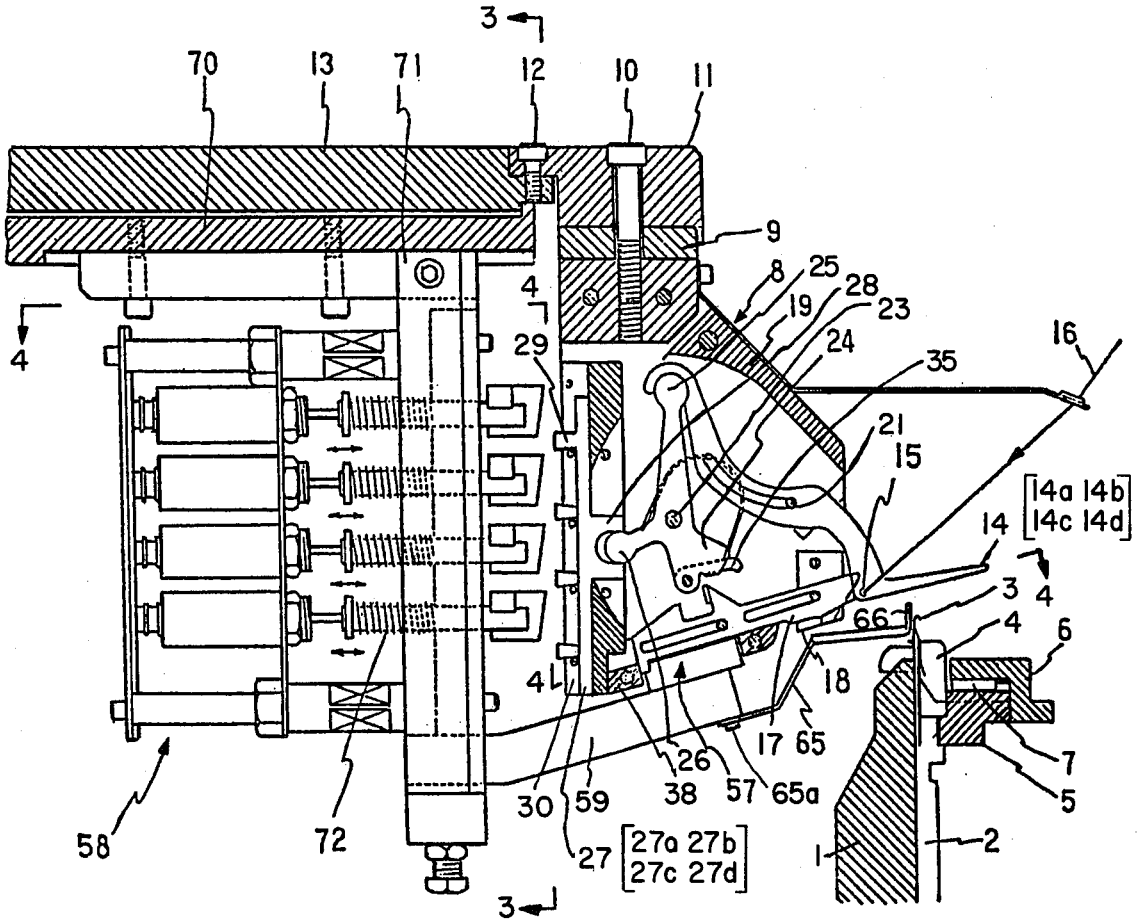

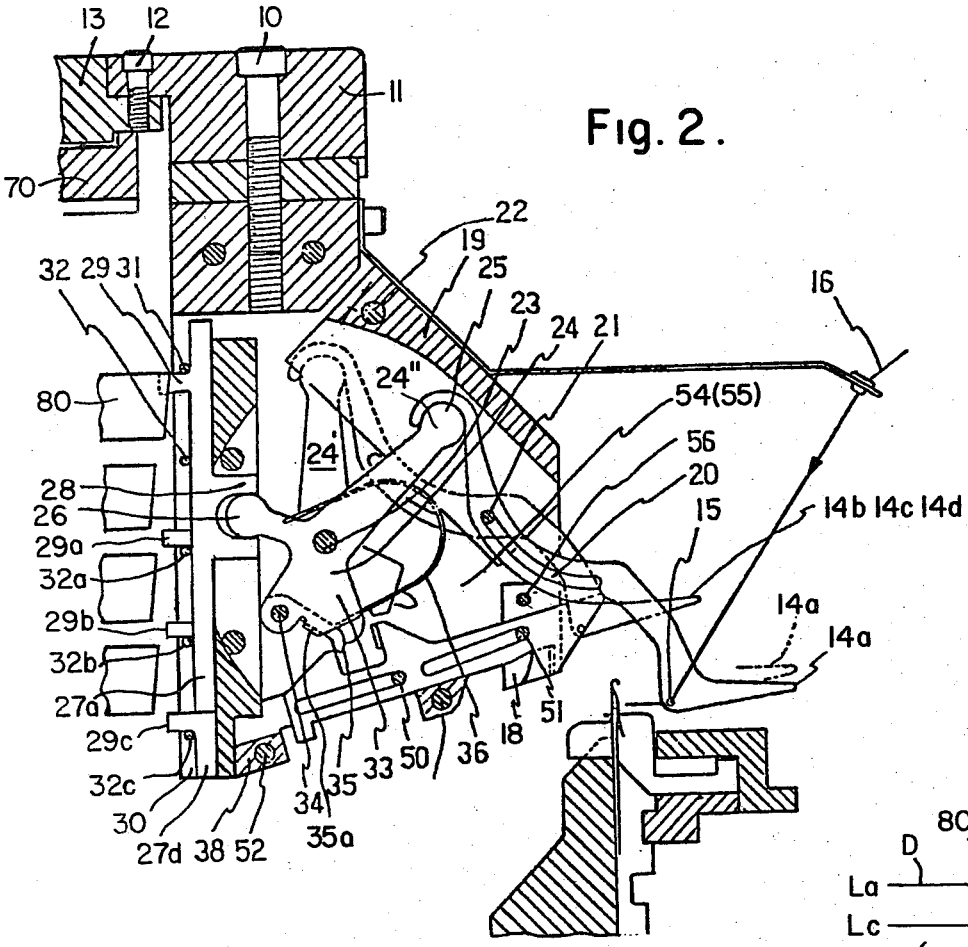
Fig. 2.
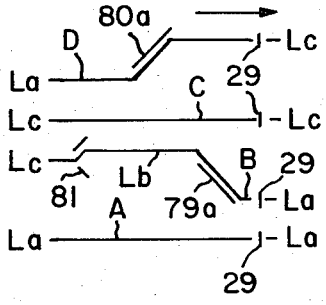
Fig. 3a.
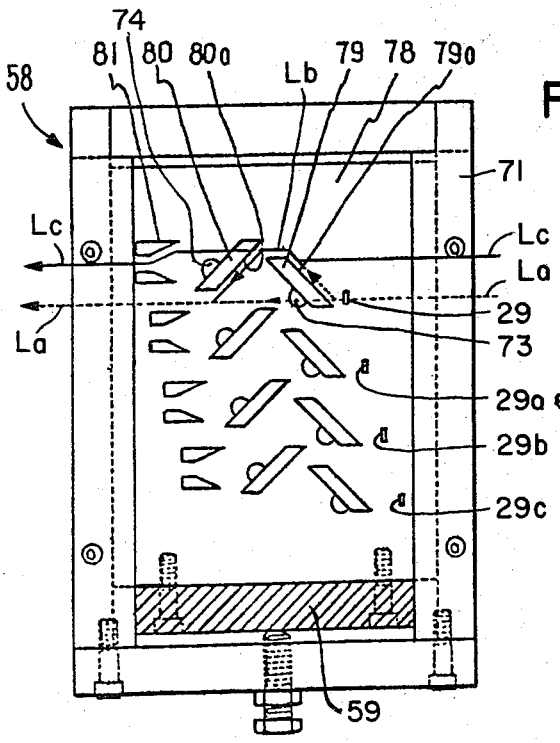
Fig. 3.
Fig. 9.
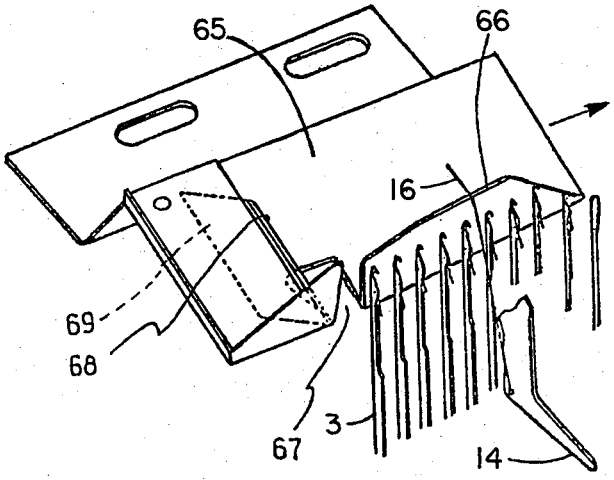

YARN FEEDING AND CHANGING APPARATUS FOR CIRCULAR KNITTING MACHINES

The present invention relates generally to the art of knitting and more particularly to yarn feeding and changing apparatus for multi-feed circular knitting machines wherein a yarn changing unit is provided at each feed of the machine, wherein each unit is provided with a plurality of yarn feeding fingers individual to a like plurality of yarns, wherein each unit is also provided with a clamp and cutter individual to each yarn finger and its yarn, wherein a remotely programmed yarn selector is provided to make a yarn selection individual to each unit, and wherein the yarn selector is provided with means to operate the clamps and cutters in the units. The invention is preferably used on sinker top multi-feed circular knitting machines having a single rotary needle circle. The yarn changing unit may also be referred to as a yarn changer, a striper and as a yarn striper box.

In the prior art, the yarn feeding and changing apparatus used on the aforesaid type of multi-feed circular knitting machines includes a striper box at each feed of the machine, an indexable yarn pattern drum and a single clamp and cutter for each box, a cam rotating in unison with the needle circle, and a continuously indexed pattern chain. Each box has a plurality of yarn feeding fingers individual to a like plurality of yarns with the boxes arranged in a stationary circle outside the needle circle. The yarn pattern drum has replaceable pattern pins to actuate the yarn fingers and is selectively indexed to change the positions of the yarn fingers to effect a yarn change. Each clamp and cutter is for all the yarns in a single box. The rotary cam is selectively movable into and out of operating position by replaceable pattern links in the pattern chain, and, when in its operating position, the cam acts to progressively index the yarn pattern drums and to operate the clamp and cutter of each box at each feed of the machine.

In the aforesaid prior art, when it is desired to change the stripe pattern it is required that the location of the pins in the yarn pattern drums and the location of the pattern links in the pattern chain be changed accordingly, keeping in mind that the stripe pattern is the result of the action of the yarn pattern drums and of the frequency with which the pattern chain permits the rotary cam to index the yarn pattern drums. The yarn striper boxes are located outside of the needle circle, where, due to their location, to their size, and to the parts associated therewith, including the clamps and cutters, they not only limit the number thereof (and the number of feeds) which can be placed upon a machine of given diameter, but also act to limit and to interfere with access to and observation of critical parts of the machine. The use of a single clamp and cutter for all of the yarns in each yarn striper box is in itself an obviously undesirable arrangement, and is the more so when the yarns being used are of different characteristics and/or denier.

In the present invention, the yarn feeding and changing apparatus includes a yarn striper box positioned within the needle circle at each feed of the machine to form a circle of boxes, and a remotely programmed yarn selector positioned within the circle of boxes, the needle circle and the yarn selector rotating in unison relative to the circle of boxes. Each box has therein a plurality of yarn feeding fingers individual to a like plurality of yarns with the fingers being movable between active and inactive positions to place their yarns into and out of yarn feeding position to the needles. Each finger has a selectively movable control jack individually related thereto and there is a rocker operatively interposed between each finger and its jack to transmit movement of the jack to the finger. The yarn selector has remotely programmed solenoid operated cams to selectively move the jacks and thereby to selectively move the yarn fingers between their active and inactive positions. Any customary type of electrically actuated remote programmer may be used to program the solenoids in the yarn selector. Each box also has a clamp and cutter individual to each yarn finger and to its yarn. Each rocker, when moving its related yarn finger and yarn to inactive position, acts to initiate the operation of the related clamp and cutter upon the related yarn, with the operation of the clamp and cutter being completed by means moving with the yarn selector. Each rocker, when moving its related yarn finger and yarn to active position, acts to prevent undesirable release of the yarn from the clamp as the yarn is introduced to and is taken by the needles. A yarn guiding member moving with the yarn selector is provided so that each of the activated yarns is introduced to the needles at the same place in the needle circle regardless of its position relative to the other yarns. A yarn cutting blade is provided to move with the yarn selector adjacent to the inner side of the needle circle to sever the activated yarns at each feed closely to the needles.

In the present invention, to change the stripe pattern it is only required that the pattern element in the remote programmer be changed. The placement of the striper boxes within the needle circle permits unobstructed observation of and access to critical parts of the machine. The boxes, with the clamps and cutters therein, are of reduced size so that a larger number thereof (and the number of feeds) can be placed upon a machine of given diameter. The use of an individual clamp and cutter for yarns of different characteristics and/or denier is obviously desirable. The mechanism of the present invention is located generally at and above the sinker level of the machine and within the cylindrical plane of the needle circle extended, where it is readily available for service.

Other yarn feeding and changing apparatus is known in the prior art for use upon multi-feed circular rib knitting machines having a rotary circle of cylinder needles and a rotary circle of dial needles, wherein a yarn changing unit is provided at each feed of the machine, and wherein a remotely programmed pattern selector is provided to change the yarns fed by the yarn changing units to the needles of the machine. Each yarn changing unit is provided with a plurality of yarn feeding fingers for a like plurality of yarns, with each unit pivotally mounted on the machine above the dial needles and their operating cams to swing radially of the machine. The active and inactive positions of the feeding ends of the yarn fingers are outside of the cylinder needles. Elements individual to each yarn finger are selectively placed in first and second radial positions by the pattern selector after which a rotary cam raises those elements in the second position to actuate selected yarn fingers to effect the yarn change. The apparatus has a single clamp and cutter mounted upon the cylinder cam ring of the machine for the plurality of yarns in each of the yarn changing units. The differences from and the advantages of the present invention over the aforesaid prior art will be apparent in the detailed description of the present apparatus.

It is an object of the present invention to provide a yarn feeding and changing apparatus for use with multi-feed sinker top circular knitting machines having a single circle of needles, wherein the apparatus has a circle of individual yarn striper boxes operatively related to and disposed within the circle of needles with a yarn striper box at each feed of the machine, and a remotely programmed yarn selector operatively related to and disposed within the circle of boxes, the circle of needles and the yarn selector being rotatable relative to the circle of boxes.

It is also an object of the invention to provide each striper box with a plurality of yarn feeding fingers individual to a like plurality of yarns and with a clamp and cutter individual to each yarn and to its finger. The fingers being movable between active and inactive positions to place their yarns into and out of yarn feeding position to the needles, and the operation of each clamp and cutter being initiated when the finger individual thereto is moved from active to inactive position, with the operation of the clamp and cutter being completed by means moving with the yarn selector. Further, undesirable opening of each clamp and cutter is prevented when its related yarn finger is moved into active position.

It is a further object to provide each finger in each box with an individual control jack and with an individual rocker operatively interposed between each finger and control jack, the relationship being such that movements of the jacks are transmitted by the rockers to move the fingers to their described positions. Each jack has a single separate level butt by means of which the jacks are selectively moved by the yarn selector to accordingly move their related rockers and fingers to desired positions.

With the above and other objects in view as will become apparent from the accompanying drawings and the description thereof, the invention resides in the construction and operation of the novel yarn feeding and changing apparatus shown and described, and as set forth in the appended claims.

Figure 4:
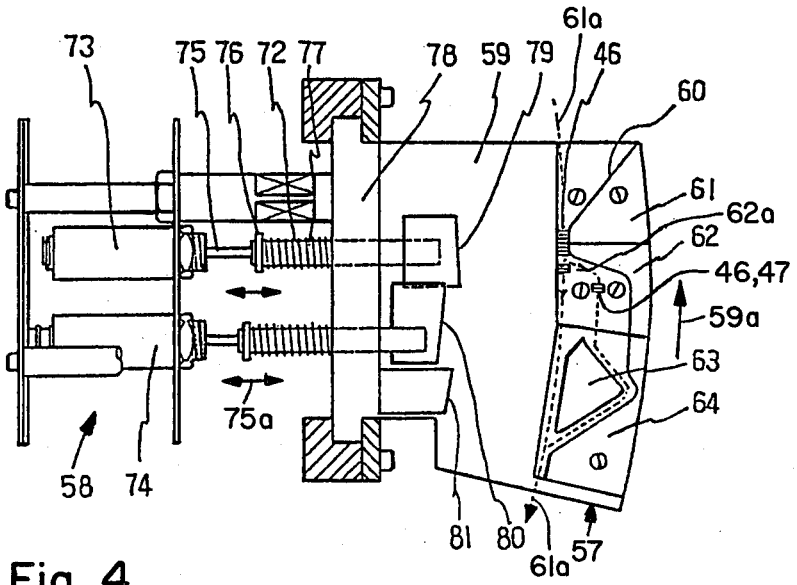
Figure 5:
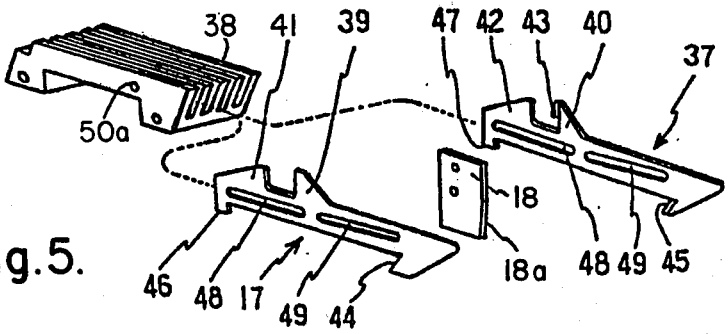
Figure 6:
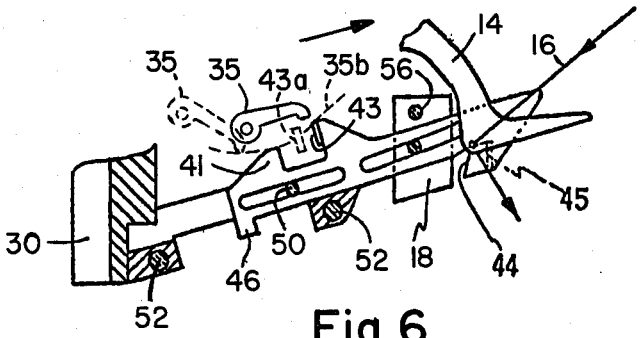
Figure 2A:
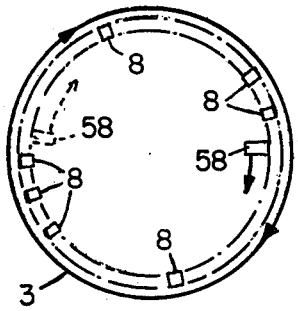
Figure 7:
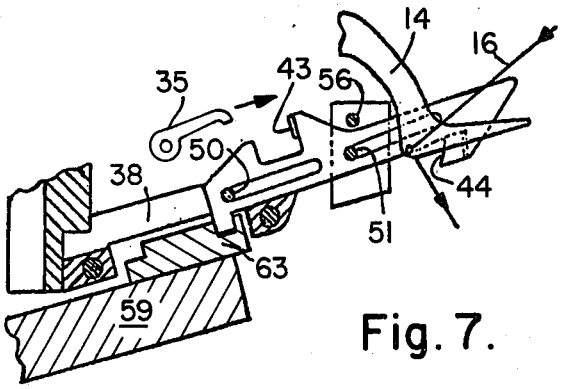
Figure 8:
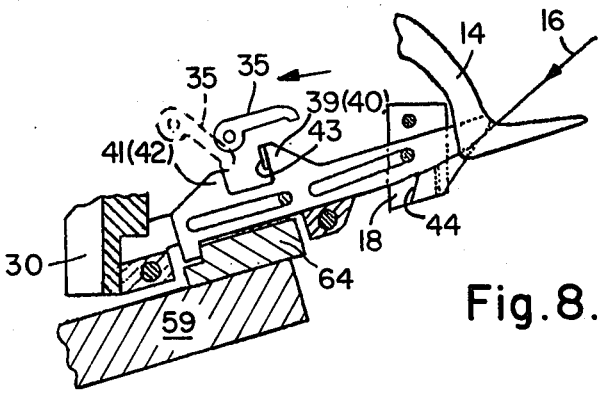

In the drawings:

FIG. 1 is a sectional view of one of the yarn striper boxes of the present invention shown with the yarn selector upon a multi-feed circular sinker top knitting machine, FIG. 2 is a view similar to FIG. 1, on an enlarged scale, showing the yarn feeding fingers, the rockers to position the fingers, the control jacks to turn the rockers, the jack selecting cams to reciprocate the jacks, and the clamps and cutters for each of the yarns, FIG. 2A is a schematic view showing the disposition of a non-rotary circle of striper boxes within a rotary needle circle and of the yarn selector rotating within the circle of striper boxes, FIG. 3 is a sectional view as taken on line A—A of FIG. 1 showing a face view of the control jack selecting cams of the yarn selector, FIG. 3A is a schematic view showing the several levels of the control jacks when the cams of the yarn selector are actuated to change yarns, FIG. 4 is a sectional view as taken on lines B—B'-B''-B of FIG. 1 showing the jack operating cams, the solenoids to select the cams, and the clamp and cutter operating cams in the yarn selector, FIG. 5 is an exploded view in perspective showing a clamp and cutter and showing a slotted bed within which a plurality of the clamps and cutters are disposed, FIG. 6 is a detail view of a clamp and cutter in a partially opened position during a yarn change, FIG. 7 is a view similar to FIG. 6 with the clamp and cutter in fully opened position, FIG. 8 is a view similar to FIGS. 5, 6 with the clamp and cutter in fully closed position, and FIG. 9 is a perspective view of a member to receive and to guide an incoming yarn to the needles of the machine.

A portion of a multi-feed circular knitting machine, upon which the present invention may be used, is shown in FIGS. 1, 2 wherein the machine has a rotary needle cylinder 1, a rotary circle of latch needles 3 in slots 2 formed in the cylinder, a rotary sinker bed 5, and a circle of rotary sinkers 4 radially movable in slots formed in the sinker bed, the sinkers being so moved by cams 7 disposed in sinker cap 6.

The disposition of the present yarn striper boxes, each designated at 8, and of the yarn selector, designated at 58, in relation to the needle circle of a machine upon which the present invention may be used, is shown schematically in FIG. 2A, wherein a non-rotary circle of individual boxes is within the rotary needle circle 3 in operative relative thereto, and wherein the yarn selector rotates within the circle of boxes in operative relation theret, the selector rotating in unison with the rotary needle circle.

Individual ones of the striper boxes 8 are located at each feed of a multi-feed circular knitting machine and are each secured by a key 9 and a bolt 10 to an outer non-rotary plate 11 of the machine, the outer plate being secured by a bolt 12 to an inner non-rotary plate 13, and the latter plate being secured to a fixed vertical post (not shown) extending axially of the machine.

Each striper box has a housing 19 within which is positioned four individual lengthwise extending yarn feeding fingers 14 (14*a*, 14*b*, 14*c*, 14*d*), four rockers 24 individually associated with the yarn fingers, and four vertically movable control jacks 27 (27*a*, 27*b*, 27*c*, 27*d*) individually associated with the rockers. Vertical movement of a jack causes its associated rocker to turn thereby to cause the corresponding yarn finger to move into and out of its yarn feeding position. Situated directly below and individually associated with each yarn finger is a clamp and cutter 17, 18, 37, the four clamps and cutters being individually received in slots of a bed 38 secured to the housing by bolts 52, 52.

Each rocker, turnable about a common pin 23 in the housing, has three spaced arms of which two arms terminate at 25 and 26 in circular shape while its third arm 33 has a claw-like member 35 pivotally secured thereto upon a pin 34 extending from the arm. Arm 33 has a bent over stop 35*a* extending from the arm and in the path of movement of claw 35 to limit its clockwise movement, as viewed in FIGS. 1, 2. Claw 35 is free to turn counterclockwise, however it is urged clockwise against stop 35 by a tensioned U-shaped spring 36 the ends of which are anchored in the claw and in rocker arm 26, respectively. Each rocker is adapted to be turned between the two positions thereof shown at 24' and 24'' in FIG. 2.

Each finger 14 has a yarn receiving aperture 15 for a yarn 16 at one end thereof and its other end rotatably interlocked with a rocker arm 25, the finger also having an enlongated curved slot 20 therein. A common pin 21, set in the housing and extending through slots 20 of the fingers, acts to support and to limit movement of the fingers into and out of yarn feeding positions when so moved by the rockers. When a rocker 24 is in its position 24', its corresponding finger 14 is in its upper inactive non-yarn feeding position of **14*b* (14*c*, 14*d*) of FIG. 2 with aperture 15 above and within the needle circle, and when a rocker is in its position 24", its corresponding finger is in its lower active yarn feeding dotted line position 14*a* of FIG. 2 with aperture 15** outside of and below the hooks of the needle circle in yarn feeding position to the needles. Turning movement of the rockers causes linear movement of the yarn fingers.

Each jack 27 has a lateral projection 28 at one side thereof with a U-shaped opening therein to rotatably receive the circularly shaped end of arm 26 of a rocker 24. Each jack also has a single operating butt extending laterally at the other side thereof with the butts of the four jacks being at equally spaced levels. Jack **27*a* has a butt 29 at the uppermost level, and jacks 27*b*, 27*c*, 27*d* have butts 29*a*, 29*b*, 20*c*, respectively, at progressively lower butt levels. The jacks are individually vertically movable in a guiding slot 30 of the housing with spaced pins 31, 32, 32*a*, 32*b*, 32*c* extending horizontally across the slot at equally spaced levels in the path of the vertically movable jack butts to limit the upward and downward movement of the jacks. The movement of each successive jack is limited by each successive pair of the pins acting upon its butt, for example, movement of jack 27*a* is limited by pins 31, 32 acting on its butt 29. When a jack 27 is in its uppermost position its corresponding rocker is in position 24" and the latters corresponding yarn finger is in lower feeding position; when a jack is in its lowermost position its corresponding rocker position is 24'** and the latters corresponding yarn finger is in upper non-feeding position.

The yarn selector 58, FIGS. 1, 4, rotates within the non-rotary circle of yarn striper boxes in unison with the rotary needle circle, FIG. 2A. It can be electrically programmed when it is between each successive pair of the striper boxes to provide an independant yarn change at each feed of the machine. The selector has a vertical plate 78 set in a frame 71 which is suitably secured to a rotary plate 70 of the machine so as to rotate with the needle cylinder. Plate 78 supports radially movable cams 79, 80 and a fixed channel or follower cam 81 to act upon butts 29 of jacks **27*a*, and also supports a pair of spaced electrically operated solenoids 73, 74 which can each be selectively energized and de-energized by the remote programmer. Cam 79 is at one end of a shaft 77 which extends through plate 78 and is connected to plunger 75 of a solenoid 73 by a coupling 76. A coil spring 72 on shaft 77 is interposed between plate 78 and coupling 76. Cam 80 is similarly mounted and connected to solenoid 74. When solenoid 73 is energized, cam 79 is caused to move radially outwardly to its active position, FIG. 4, wherein at each box it acts upon butt 29 of jack 27*a* while each spring 72 is energized at the same time. When solenoid 73 is de-energized, spring 72 returns cam 79 to its inactive position. Similarly, cam 80 controlled by solenoid 74 and a spring similar to spring 72 is moved between its active and inactive positions. Cams 79, 80 move individually in the two directions of arrow 75*a*. Plate 78 similarly supports cams similar to cams 79, 80, 81, and solenoids similar to solenoids 73, 74, and springs similar to springs 72, to act similarly upon butts 29*a*, 29*b*, 29*c* of jacks 27*b*, 27*c*, 27*d***, respectively.

Referring to FIGS. 3, 3A, with the yarn selector 58 moving in the direction of the arrow in FIG. 3A, to action of cams 79, 80, 81 upon butt 29 of jack **27*a* in each box will be set forth. The jacks 27 are moved to three vertical positions to move their related rockers 24 and yarn fingers 14 to three corresponding positions. When it is desired that the finger and its yarn be in the non-feeding position of FIG. 1, the cam 79 will be in its non-operating position and jack butt will remain at the low level La of the line A in which it is adjacent to stop pin 32. At this time jack 27*a* is in its low level position and its related yarn finger is in idle position. Cam 80 may also be in non-operating position at this time. When it is desired to place yarn finger 14*a* into active yarn feeding position of FIG. 2, cam 79 is made active by its solenoid 73 so that its cam face 79*a* will engage butt 29 and raise the same, line B, from low level La to high level Lb (adjacent stop pin 31), after which channel cam 81 quickly lowers the butt to intermediate level Lc. The jack 27*a* in high level position (butt 29 at level Lb) via related rocker 24 moves the yarn finger to an overthrown full line position 14*a*, FIG. 2, and when the jack 27*a* is moved down to intermediate level position by cam 81 (butt 29 at level Lc), it moves finger 14*a* back to its dotted line running position. Such temporary overthrown movement of the yarn finger provides slack in the yarn being made active to assist in the yarn change. Then, as in line C, butt 29 remains at level Lc for as long as yarn 16 is being fed to the machine with cams 79, 80 in their inactive positions. When it is desired to place finger 14*a* in idle non-yarn feeding position (and to replace it with another of the yarn fingers), line D, cam 80 is made active by its solenoid 74 so that its face 80*a* will lower butt 29 from level Lc to level La, adjacent stop pin 32, thereby moving jack 27*a* to its low level in which it moves the yarn finger to its idle inactive position. The yarn finger will thereafter be idle for so long as jack 27*a* is at its low level. The yarn fingers 14*b*, 14*c*, 14*d* are similarly placed into and out of their feeding positions (as determined by the remote programmer acting upon the yarn selector) by the action of cams similar to cams 79, 80, 81 and of solenoids similar to solenoids 73, 74 acting upon jack butts 29*a*, 29*b*, 29*c* of jacks 27*b*, 27*c*, 27*d*, respectively. When a yarn change is desired, the jack 27** then at intermediate level is moved to low level and a desired one of the remaining jacks (then at low level) is moved to high and then to intermediate level. It will be seen that there may be any combination of any number of the jacks at low and/or at intermediate levels at the same time, corresponding to the yarn fingers in and out of yarn feeding position.

A clamp and cutter individual to each yarn finger 14 and its yarn 16 is shown in FIGS. 5, 6, 7, 8 wherein a fixed blade 18 is provided between a movable clamping blade 17 and a movable cutting blade 37. The clamping blade has a hook 44 at its forward end to engage and to move the yarn so as to clamp and hold it between the near surfaces of the clamping and of the fixed blades. The cutting blade has a cutting hook 45 at its forward end to cut the yarn between itself and a cutting edge **18*a* of the fixed blade. The description of the clamp and cutter shown is applicable to the other clamps and cutters individual to the other yarn fingers and their yarns. Each movable pair of clamp and cutter blades 17, 37 is positioned to slide in a slot in slotted bed 38 which is secured to the housing by bolts 52, 52. The blades 17, 37 each have similar front and rear slots 49 and 48 respectively. Clamp 17 has spaced lateral extensions 39, 41, 46** while cutter 37 has similarly spaced lateral extensions 40, 42, 47. Extension 40 of blade 37 has a stop 43 at right angles thereto in the path of extension 39 of blade 17 so that movement of cutter 37 in the direction of the arrow in FIG. 6 causes clamping blade to move therewith. A pin 50 extends through rear slots 48 of the blades 17, 37 and through a suitable aperture 50*a* in bed 38, while a pin 51 extends through front slots 49 of these blades, through fixed blade 18, and through sides 54 (55) of the housing, FIG. 2. A pin 56 also extends through blade 18 and through sides of the housing. Hook 44 is closer to blade 18 than hook 45.

In FIG. 6 yarn finger 14 is in idle position and the clamp and cutter blades are in partially opened position, the blades having been moved (by means to be described) in the direction of the arrow from their closed position of FIG. 8.

In FIG. 7 the clamp and cutter blades are now in fully opened position with the blades having been moved further (by means to be described) from the fixed blade in the direction of the arrow. Yarn 16 is now able to enter between fixed blade 18 and hooks 44, 45 of the movable blades.

In FIG. 8 the clamp and cutter is in fully closed position with the blades having been moved in the direction of the arrow with the yarn 16 having been clamped between the near surfaces of blade 18 and hook end 14 of the clamping blade and with the yarn having been cut between the cutting edges of blade 18 and of hook 45 of the cutting blade.

A horizontal plate 59, secured to and extending from the underside of vertical bracket 78, rotates with the yarn selector 58 in the direction of arrow 59*a*, FIGS. 1, 4. Affixed to the upper side of plate 59 are cams 61, 62, 63, 64 to act upon butts 46, 47 of each pair of cutting and clamping blades in each striper box. When there is no yarn change at a feed, there is no actuation of any of the clamping and cutting blades in the box at that feed and the butts 46, 47 of the blades remain in idle cam path 61*a* as the yarn selector rotates. Cam face 60 of cam 61 assures that butts 46, 47 remain in path 61*a*.

When a feeding yarn, such as 16 in a finger 14, is to be idled, the rocker related to such finger turns from its position 24'' to its position 24' while the finger itself moves from its dotted line position 14*a* to its full line position 14*b* in FIG. 2 where its yarn aperture is inside of and above the level of the hooks of the needles and is adjacent to the clamp and cutter. During such turning movement of the rocker, its claw 35 moves along arc 35*b* from its dotted line to its full line position, FIG. 6, and during such movement the claw engages stop 43 (shown in dotted lines at 43*a*) and moves the blades 17, 37 in a first step from their closed position of FIG. 8 to their partially opened position of FIG. 6. As the rocker completes its turning movement of claw disengages from stop 43 and comes to rest in the full line position. Such partially opened position of the blades is indicated in FIG. 4 where their butts 46, 47 (which were in path 61*a* while the yarn finger was in feeding position) have been moved out of path 61*a* to a pathway 62*a* within the face of guard cam 62. As butts 46, 47 remain in path 62*a*, they are engaged by and move outwardly along the face of cam 63, thereby to move the blades 17, 37 in a second step to their fully opened position of FIG. 7. Thereafter, cam 64 engages butts 46, 47 to retract blades 17, 37 to their fully retracted positions of FIG. 8 during which the idled yarn is clamped and cut. Butts 46, 47 remain in path 61*a* except when a yarn is to be idled.

When an idled yarn, such as 16 in finger 14, is to become a feeding yarn, rocker 24 of such finger is turned from its position 24' to its position 24'' while the finger itself moves from its full line position of FIG. 1 to its dotted line position 14*a* in FIG. 2 in which the finger aperture 15 is outside of and below the level of the needle hooks of the needle circle. FIG. 8 shows the relationship of the parts with the clamp and cutter in fully closed position wherein the end of the idled yarn is held in the clamp between blades 17, 18. During turning movement of the related rocker, the claw 35 moves from its full line to its dotted line position, FIG. 8, wherein the spring urged claw engages with projections 41, 42 of blades 17, 37 to yieldingly retain the latter in their fully closed positions and thereby to continue to hold the yarn in clamped position between blades 17, 18. If the yarn end is not securely held it can be prematurely pulled out of the clamp when the yarn is taken by the needles and defect will result.

A device 65, FIG. 9, is provided to cause each yarn as it moves to feeding position to be fed at the same place along the needle circle. The device is secured to the underside of plate 59 at 65*a* just inside the needle circle, FIG. 1, where it rotates with the yarn selector. The device has an arc shaped cam face 66 the upper edge of which extends above the needle hooks and tapers downwardly to a cut out 67 where a cutting blade 68 is positioned to extend into the cut out, being so held in place by a flat spring 69. Any yarn, such as 16, placed into feeding position by a finger 14 engages the upper edge of cam face 66 and slides along the same and into cut out 67 where it is taken by the needles and where blade 68 cuts the end of the yarn adjacent the inside of the needle circle. In this way, each of the plurality of yarns regardless of its relative position to the other yarns will be fed to the same point of the needle circle.

A yarn guide (not shown) is provided outside of and adjacent to the circle of needles at each feed to protect the opened latches of the needles and to feed any of the selected yarns to the needles moving past the same.

A plurality of vertically spaced stationary electrically conductive collector rings are placed axially on the center post of the machine and a like plurality of similarly spaced electrically conductive brushes are placed on the rotary yarn selector, with each brush in contact with a ring so that as the yarn selector rotates each of the brushes remains in electrical contact with a corresponding collector ring. Each brush is electrically connected to a solenoid and each collector ring is electrically connected to the remote programmer, whereby directives made by the programmer are received by the solenoids.

I claim:

1. Yarn feeding and changing apparatus for multi-feed circular knitting machines having a circle of needles, the apparatus having a series of yarn striper boxes positioned within the circle of needles in individual relation to the feeds of the machine with the boxes forming a circle thereof, and a remotely programmed yarn selector positioned within the circle of boxes, the circle of needles and the selector rotating in unison relative to the circle of boxes, the selector providing programs individual to individual ones of the boxes during the movement therebetween, individual ones of the boxes having therein a plurality of individual yarn fingers individually threaded with a like plurality of yarns and also having therein a like plurality of clamps and cutters individually related to the yarn fingers and to their yarns, the yarn fingers being movable between active and inactive positions wherein their yarns are placed into and out of feeding positions to the needles and wherein the clamps and cutters are operated upon to cut and to clamp the yarns, the selector having means to provide a selection individual to the yarn fingers in individual ones of the boxes to move selected ones of the yarn fingers between their active and inactive positions and to operate the individual clamps and cutters related to the selected yarn fingers to cut and to clamp the corresponding yarns.

2. Apparatus as in claim 1 wherein each clamp and cutter is movable in a first step to a partially opened position and in a second step to a fully opened position to receive therein the yarn individual thereto, wherein the clamp and cutter is thereafter movable to a closed position to clamp and to cut the yarn, wherein a first means acts to move the clamp and cutter to its partially opened position when the yarn finger feeding the yarn is moved from its active to its inactive position, and wherein a second means thereafter acts to move the clamp and cutter to its fully opened position, the first and the second means acting to place the clamp and cutter in its fully opened position.

3. Apparatus as in claim 1 wherein each clamp and cutter is movable to an open position to receive therein the yarn individual thereto when the yarn finger feeding the yarn is moved from its active to its inactive position, wherein the clamp and cutter is thereafter movable to a closed position to clamp and to cut the yarn, thereby to hold the yarn in the clamp, and wherein means, in addition to the clamp itself, acts to retain the clamp in its closed position to continue to hold the yarn therein when the yarn finger is returned from its inactive to its active position to replace the yarn into feeding position to the needles.

4. Apparatus as in claim 1 wherein a rocker is operatively related to and is interposed between each yarn finger and the clamp and cutter individual thereto, wherein the rocker acts to move the yarn finger into active and inactive positions, wherein the rocker acts to move the clamp and cutter to a partially opened position when the yarn finger is moved into inactive position by the rocker, and wherein the rocker also acts upon the clamp and cutter to continue to clamp the yarn when the yarn finger is moved into active position by the rocker.

5. Apparatus as in claim 1 wherein the boxes are of like construction with similar parts thereof similarly positioned therein, wherein the yarn selector is provided with a plurality of pairs of cams of which each pair of cams is operatively and individually associated with each of the similarly positioned ones of the plurality of yarn fingers in each of the boxes, wherein a first electrically operated solenoid individually activates one cam of each pair thereof to move the yarn fingers associated therewith in each of the boxes from their inactive into their active positions while a second electrically operated solenoid individually activates the other cam of each pair thereof to move the last mentioned yarn fingers from their active into their inactive positions.

6. Apparatus as in claim 5 wherein each pair of cams has a follower cam associated therewith, and wherein each follower cam acts upon the yarn fingers in active position to withdraw the same from such active position to a second active position in which their yarns remain in feeding position to the needles, the yarn fingers remaining in their first mentioned active position during the introduction of the yarns to the needles.

7. Apparatus as in claim 6 wherein a like plurality of jacks are operatively and individually associated with the plurality of yarn fingers in each of the boxes, wherein each jack has a butt thereon, wherein each butt is at an individual one of a like plurality of spaced positions on the jacks, and wherein the pairs of cams act upon the butts to move the jacks to move the yarn fingers into and between their active and inactive positions.

8. Apparatus as in claim 7 wherein a rocker is operatively interposed between each jack and its associated yarn finger in each of the boxes to transmit movement of the jacks to the fingers to move the latter into and between their active and inactive positions.

9. Apparatus as in claim 1 wherein an arc shaped yarn guide member is provided to rotate in unison with the yarn selector and with the circle of needles in a circular pathway extending between the stationary circle of yarn boxes and the rotary circle of needles, wherein the guide member extends above the circle of needles, wherein in each yarn striper box each yarn extending from its clamp and cutter to its yarn finger contacts the rotary guide member when the yarn finger is moved to an active position, wherein the guide member deflects the yarn to a position above and out of yarn taking position by the needles, and wherein the yarn slides along the guide member to and off the end thereof to assume a position in which it is taken by the needles.

10. Apparatus as in claim 9 wherein the yarn extends between the clamp and cutter and the needles taking the same, and wherein means is provided to sever the yarn therebetween.

* * * * *